US010576649B2

(12) United States Patent
Levsen

(10) Patent No.: US 10,576,649 B2
(45) Date of Patent: Mar. 3, 2020

(54) ROTARY KNIFE BLADE WITH DOUBLE BEVELED INSIDE SURFACE

(71) Applicant: Hantover, Inc., Overland Park, KS (US)

(72) Inventor: Clark A. Levsen, Shawnee, KS (US)

( * ) Notice: Subject to any disclaimer, the term of this patent is extended or adjusted under 35 U.S.C. 154(b) by 439 days.

(21) Appl. No.: 14/693,697

(22) Filed: Apr. 22, 2015

(65) Prior Publication Data

US 2015/0298328 A1 Oct. 22, 2015

Related U.S. Application Data

(60) Provisional application No. 61/982,750, filed on Apr. 22, 2014.

(51) Int. Cl.
*B26B 25/00* (2006.01)

(52) U.S. Cl.
CPC ..... *B26B 25/002* (2013.01)

(58) Field of Classification Search
CPC ..... B26B 25/002; A22C 17/00; A22C 17/04; Y10T 83/9377; Y10T 83/9379; Y10T 83/9403
USPC ..... 30/276, 346, 347, 329, 282, 283, 289; 606/132, 180; 452/132–137
See application file for complete search history.

(56) References Cited

U.S. PATENT DOCUMENTS

| | | | | |
|---|---|---|---|---|
| 5,692,307 | A | 12/1997 | Whited et al. | |
| 8,037,611 | B2 | 10/2011 | Levsen | |
| 8,250,776 | B2 | 8/2012 | Yoo et al. | |
| 8,281,493 | B2 | 10/2012 | Levsen | |
| 8,756,819 | B2 * | 6/2014 | Whited | B26B 25/002 30/276 |
| 8,893,391 | B2 | 11/2014 | Levsen | |
| 9,168,663 | B2 | 10/2015 | Levsen | |
| 2007/0283573 | A1 | 12/2007 | Levsen | |
| 2013/0025134 | A1 | 1/2013 | Mascar et al. | |
| 2013/0025137 | A1 * | 1/2013 | Whited | A22B 5/165 30/276 |
| 2014/0074118 | A1 | 3/2014 | Esarey et al. | |
| 2014/0326886 | A1 | 11/2014 | Jennings et al. | |

OTHER PUBLICATIONS

International Search Report and Written Opinion from PCT Application No. PCT/US2015/027140 entitled Rotary Knife Blade With Double Beveled Inside Surface (dated Jul. 21, 2015).

* cited by examiner

*Primary Examiner* — Phong H Nguyen

(57) ABSTRACT

A rotary knife includes a rotatable annular blade. The blade includes a blade wall presenting an annular inner surface terminating at a cutting edge. The annular inner surface includes a first section and a second section, with the first section extending from the cutting edge and the second section being located further from the cutting edge than the first section. The first and second sections define first and second angles, respectively, relative to an imaginary plane transverse to the axis about which blade rotates. The second angle is greater than the first angle.

12 Claims, 6 Drawing Sheets

ROTARY KNIFE BLADE WITH DOUBLE BEVELED INSIDE SURFACE

RELATED APPLICATION

This application claims the benefit of U.S. Provisional Application Ser. No. 61/982,750, filed Apr. 22, 2014 entitled ROTARY KNIFE BLADE WITH DOUBLE BEVELED INSIDE SURFACE, which is hereby incorporated in its entirety by reference herein.

BACKGROUND

1. Field

The present invention relates generally to powered knives, such as those commonly used in meat processing plants. More specifically, embodiments of the present invention concern a rotary knife having a rotating blade.

2. Discussion of Prior Art

Powered rotary knives that are used in the meat processing industry for dressing an animal carcass are known in the art. The process of dressing the carcass normally involves the removal of meat and fat from various bones as well as cutting various bones. Powered rotary knives enable workers to perform this process with great efficiency. Such prior art knives include a housing and a rotating annular blade that can be removed for sharpening or replacement.

Those having ordinary skill in the art will specifically appreciate that carcass dressing operations are often repetitive, and it is highly desirable to minimize the manual force required to move the knife through tissue, in an effort to reduce worker fatigue or injury. It has been determined that one of the principal factors contributing to resistence to the knife moving through the tissue is surface tension between the rotating blade and the tissue. More particularly, it is believed that the surface tension is significantly reduced if an air gap can be created between the blade surface and the tissue. Prior attempts to provide such a gap (e.g., grinding hollowed areas within the interior blade surface) are deficient. Furthermore, the blade must still be capable of being re-sharpened multiple times.

SUMMARY

The following brief summary is provided to indicate the nature of the subject matter disclosed herein. While certain aspects of the present invention are described below, the summary is not intended to limit the scope of the present invention.

Embodiments of the present invention provide a annular blade that does not suffer from the problems and limitations of the prior art rotary knives set forth above.

A first aspect of the present invention concerns a rotary knife comprising a frame, a blade housing supported on the frame, and an annular blade supported on the blade housing for rotational movement about an axis. The blade presents an annular inner blade surface that terminates at a cutting edge. The inner blade surface includes first and second sections. The first section extends from the cutting edge and the second section is located further from the cutting edge than the first section. The first and second sections of the inner blade surface are angled relative to one another.

A second aspect of the present invention concerns an annular blade for a rotary knife, wherein the knife includes a housing for supporting the blade. The blade includes a support section configured to be rotatably supported on the housing for rotational movement about an axis. The blade also includes an annular inner blade surface that terminates at a cutting edge. The inner blade surface includes first and second sections. The first section extends from the cutting edge and the second section is located further from the cutting edge than the first section. The first and second sections of the inner blade surface are angled relative to one another.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
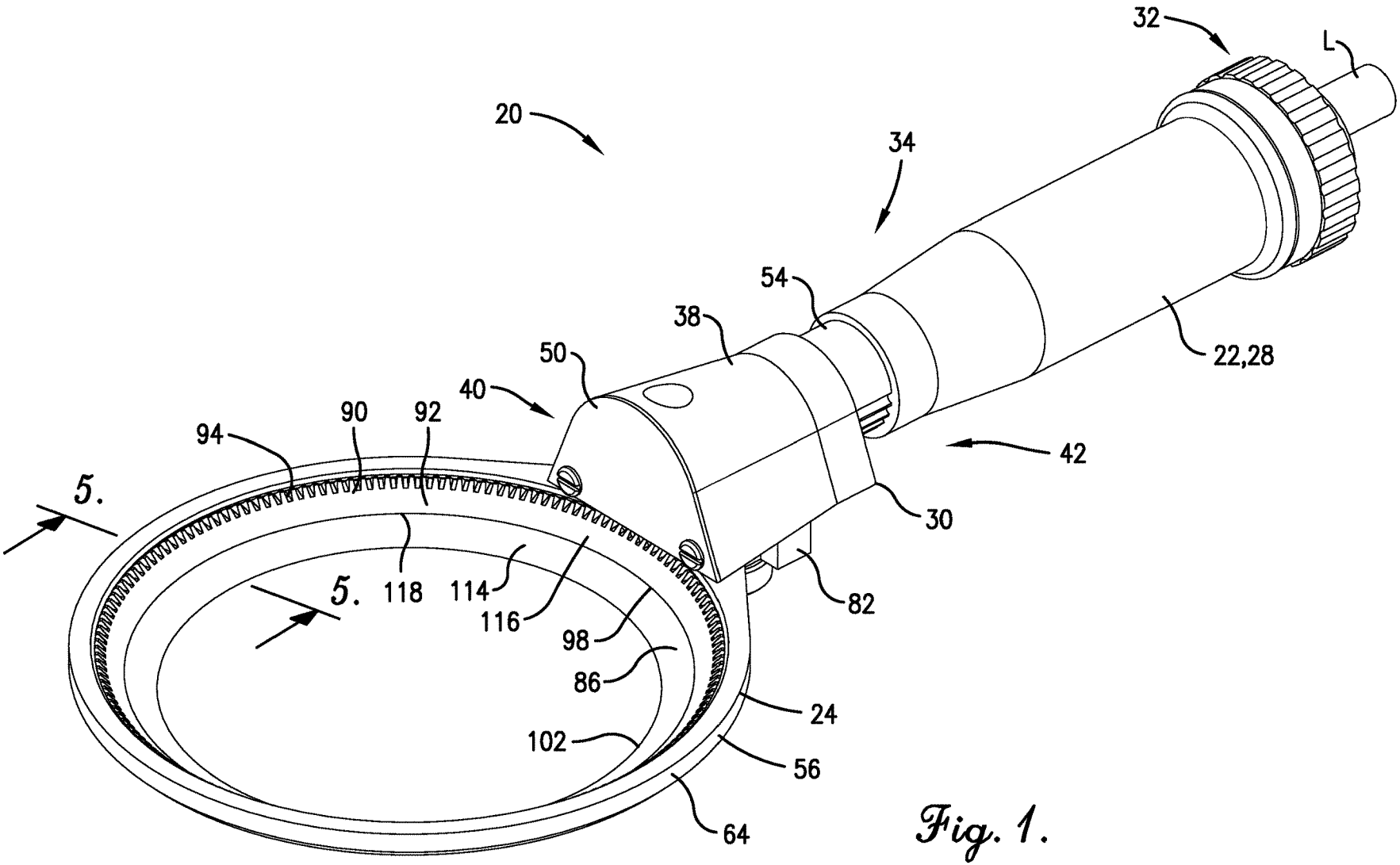
FIG. 1 is a upper perspective of a rotary knife constructed in accordance with a preferred embodiment of the present invention, with the rotary knife depicted as being operably coupled to a pneumatic supply line.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 2:
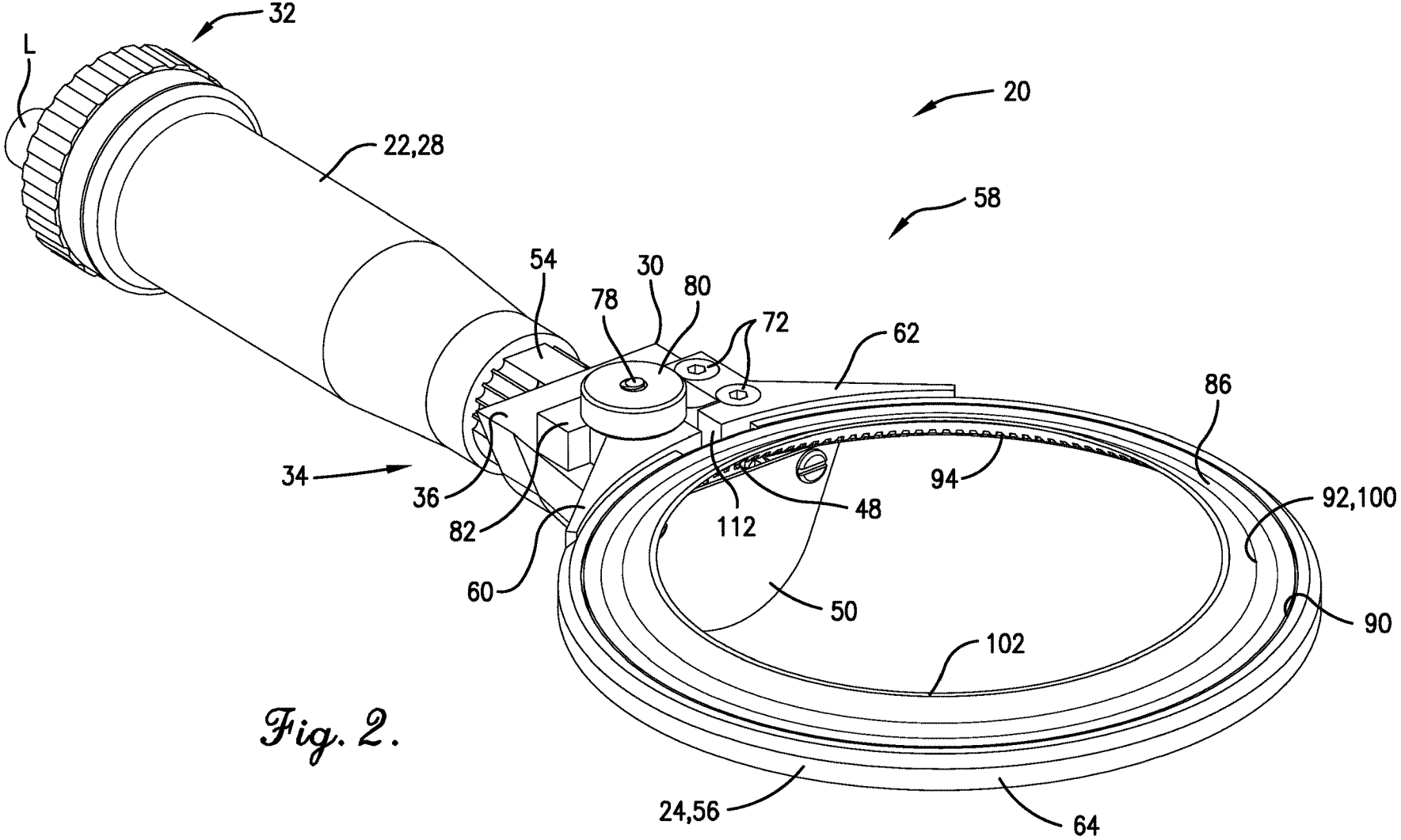
FIG. 2 is a lower perspective of the rotary knife shown in FIG. 1.

Turning initially to FIGS. 1 and 2, a rotary knife 20 is constructed in accordance with a preferred embodiment of the present invention. The illustrated rotary knife 20 is particularly well suited for use in meat processing facilities, although other knife applications are entirely within the ambit of the present invention. The illustrated rotary knife 20 is preferably pneumatically powered by a pressurized air source (not shown), e.g., an air compressor. However, the principles of the present invention are equally applicable where the rotary knife is driven by alternative external power sources, such as sources that transmit power through hydraulic power or electrical power. The rotary knife 20 broadly includes a frame 22, a blade carrier assembly 24, and a rotating blade assembly 26.

Figure 3:
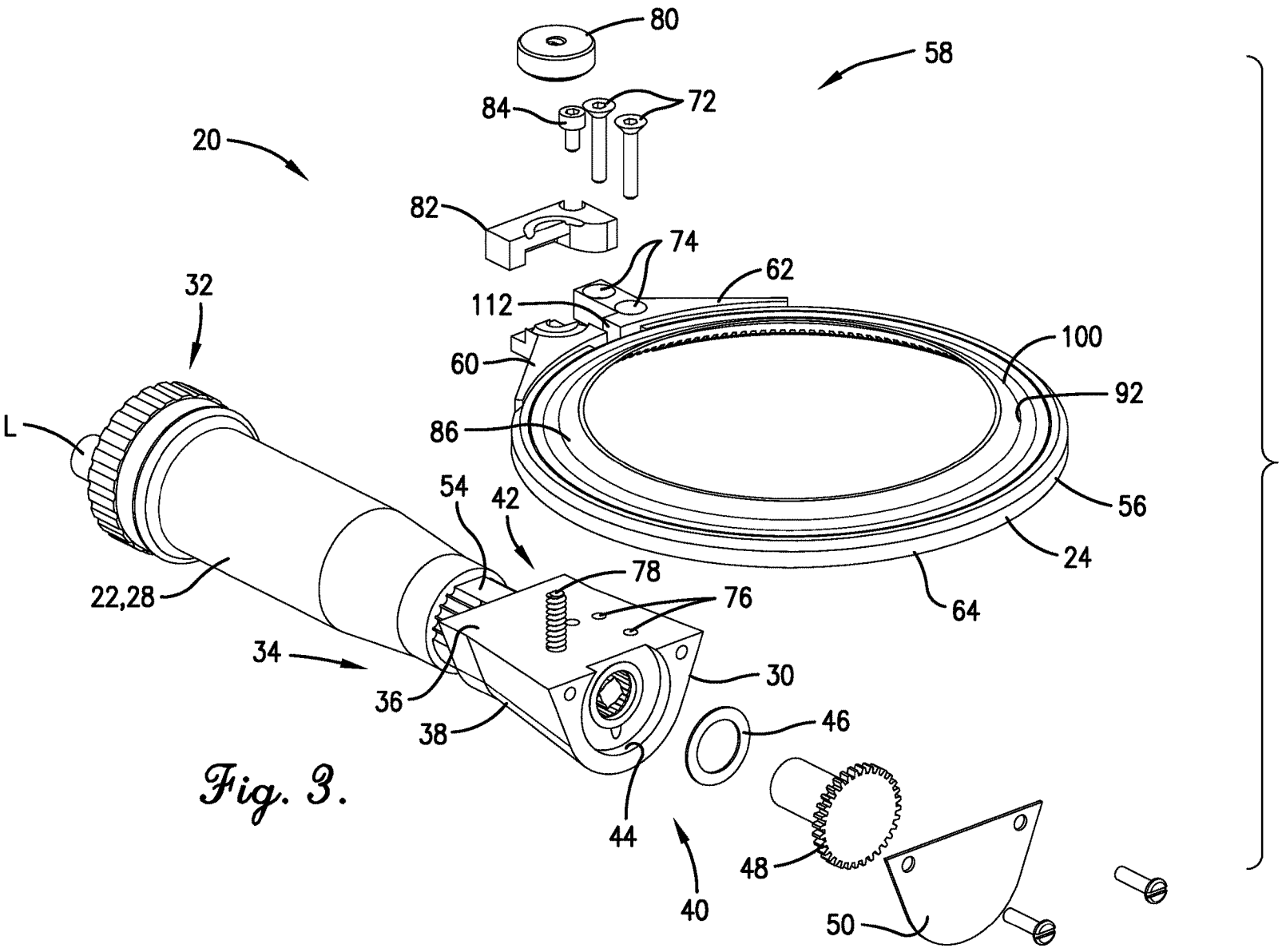
FIG. 3 is a lower perspective of the rotary knife similar to FIG. 2, but showing various components of the knife exploded away from one another.

The frame 22 preferably includes a grip housing 28 and a base 30. The grip housing 28 has a generally cylindrical shape and extends between a proximal connector end 32 for interfacing with a pneumatic supply line L (see FIGS. 1-3) and a distal end 34. The grip housing 28 further presents an internal passage (not shown) that houses a pneumatic motor (not shown). The frame 22 is depicted in the drawings as a handle configured for human grasping; however, it is consistent with the principles of the present invention for the frame 22 to include other configurations such as various handle designs, or attachments to facilitate automated function.

The base 30 includes a body with a generally flat wall 36 and a curved wall 38 that extend between distal and proximal ends 40,42 of the base 30. The body presents a gear-receiving socket 44 that extends distally from the proximal end 42. The socket 44 is sized to receive a washer 46 and a spur gear 48 and to permit rotation of the spur gear 48. The spur gear 48 is interconnected with and is driven by the pneumatic motor. The base 30 also includes a cover 50 removably attached to a distal end 40 of the base 30, with the cover 50 being in a generally covering relationship with the socket 44. Alternative pinion drives and covers are within the ambit of the preferred invention.

Various means for attaching the base 30 to the grip housing 28 are known to those skilled in the art. For example, U.S. Pat. No. 8,893,391, issued Nov. 25, 2014, entitled ROTARY KNIFE WITH MECHANISM FOR CONTROLLING BLADE HOUSING, discloses a such a means and is hereby incorporated in its entirety by reference herein. Suffice it to explain that the base 30 is attached to the grip housing 28 through the use of a threaded sleeve (not shown) and a bushing 54. In particular, the bushing 54 is slidably received on the sleeve. The sleeve is threaded into the distal end 34 of the housing 28 and the proximal end 42 of the base 30. Thus, the grip housing 28, base 30, and sleeve cooperatively present a chamber to receive a motor and drive train (not shown) operable to drive the spur gear 48.

Turning to FIGS. 1-4, the blade carrier assembly 24 supports the blade during knife operation and permits blade rotation. In the illustrated embodiment, the blade carrier assembly 24 generally includes an expandable blade housing 56 and a blade housing expansion assembly 58. The illustrated expansion assembly 58 is configured to attach the blade housing 56 to the base 30 and facilitate controlled movement of the blade housing 56 between a blade-securing condition (see FIG. 2) and a blade-releasing condition (not shown). It will be appreciated, however, that the principles of the present invention are equally applicable to alternative blade carrier assemblies and means for securing the blade housing 56 to the frame 22. For example, the blade housing 56 may alternatively be clamped to the frame 22 by a traditional pinion cover, if desired.

The illustrated blade housing 56 is substantially unitary and annular. The blade housing 56 includes an annular ring that extends continuously between adjacent housing ends 60,62. The ring includes an arcuate outer surface 64 and an arcuate inner surface 66. The inner surface 66 presents a groove 68 which serves as a race for rotatably supporting the blade assembly 26 as will be discussed (see FIG. 4). The groove 68 extends along the perimeter of the housing 56 between the ends 60,62. Thus, the blade housing presents a socket 70 that receives the blade.

While the illustrated blade housing 56 includes the single groove 68, it is consistent with the principles of the present invention for the blade housing 56 to alternatively include multiple grooves for engagement with the blade assembly 26. Moreover, it is also within the ambit of the present invention for the groove 68 to include alternative shapes or surface features. Additional details of a rotary knife with such alternative groove structures are disclosed in U.S. Pat. No. 8,037,611, issued Oct. 18, 2011, entitled ROTARY KNIFE WITH BLADE BUSHING, which is hereby incorporated in its entirety by reference herein.

The blade housing 56, as well as the frame 22, are preferably manufactured from a tempered steel to resist oxidation and corrosion within the adverse environment of a slaughterhouse. However, the principles of the present invention are equally applicable where the blade housing 56 and frame 22 include other metallic or non-metallic materials such as brass, composite, aluminum, or stainless steel. The blade housing 56 or frame 22, either entirely or partly, may alternatively include an outermost layer of brass, composite, aluminum, or stainless steel that is suitable for surface-to-surface engagement with the blade assembly 26. In this manner, such an outermost layer, whether coated, adhered, or otherwise secured onto the base material, may provide an optimal surface for low-friction bearing engagement with the blade assembly 26. However, the outermost layer may be included for other purposes, such as corrosion resistance, aesthetic qualities, or other performance requirements.

The blade housing 56 is preferably attached to the base 30 by any suitable means. In the illustrated embodiment, the expansion assembly 58 serves to adjustably support the housing 56 on the base 30. The expansion assembly 58 is described in the above-incorporated '391 patent and is well understood by those skilled in the art. It is therefore sufficient to explain that the end 62 of housing 56 is fixed against the flat wall 36 of the base 30 by fasteners 72 that extend through holes 74 and into threaded holes 76 in the base 30 (see FIG. 3). Furthermore, the other end 60 the blade housing 56 is selectively clamped to the base 30 so as to prevent unintended expansion of the blade housing 56. More particularly, a threaded stud 78 fixedly projecting from the flat wall 36 and through the housing end 60 threadably receives nut 80. The nut 80 is tightened on the stud 78 to clamp the housing end 60 in place. If it is desired to expand the housing 56 (e.g., during blade and/or bushing replacement), the nut 80 is loosened sufficiently to permit the end 60 to be shifted relative to the fixed housing end 62. In the preferred embodiment, the expansion assembly 58 includes a lever 82 for facilitating manual expansion of the housing 56. The lever 82 is swingably connected to the base 30 by threaded fastener 84, such that turning of the lever 82 in a clockwise direction (when viewing the knife 20 from below) causes progressive engagement with the shiftable end 60, and thereby expansion of the housing 56. As previously noted, however, the blade housing may be alternatively configured and otherwise secured relative to the frame without departing from the spirit of the present invention.

Figure 4:
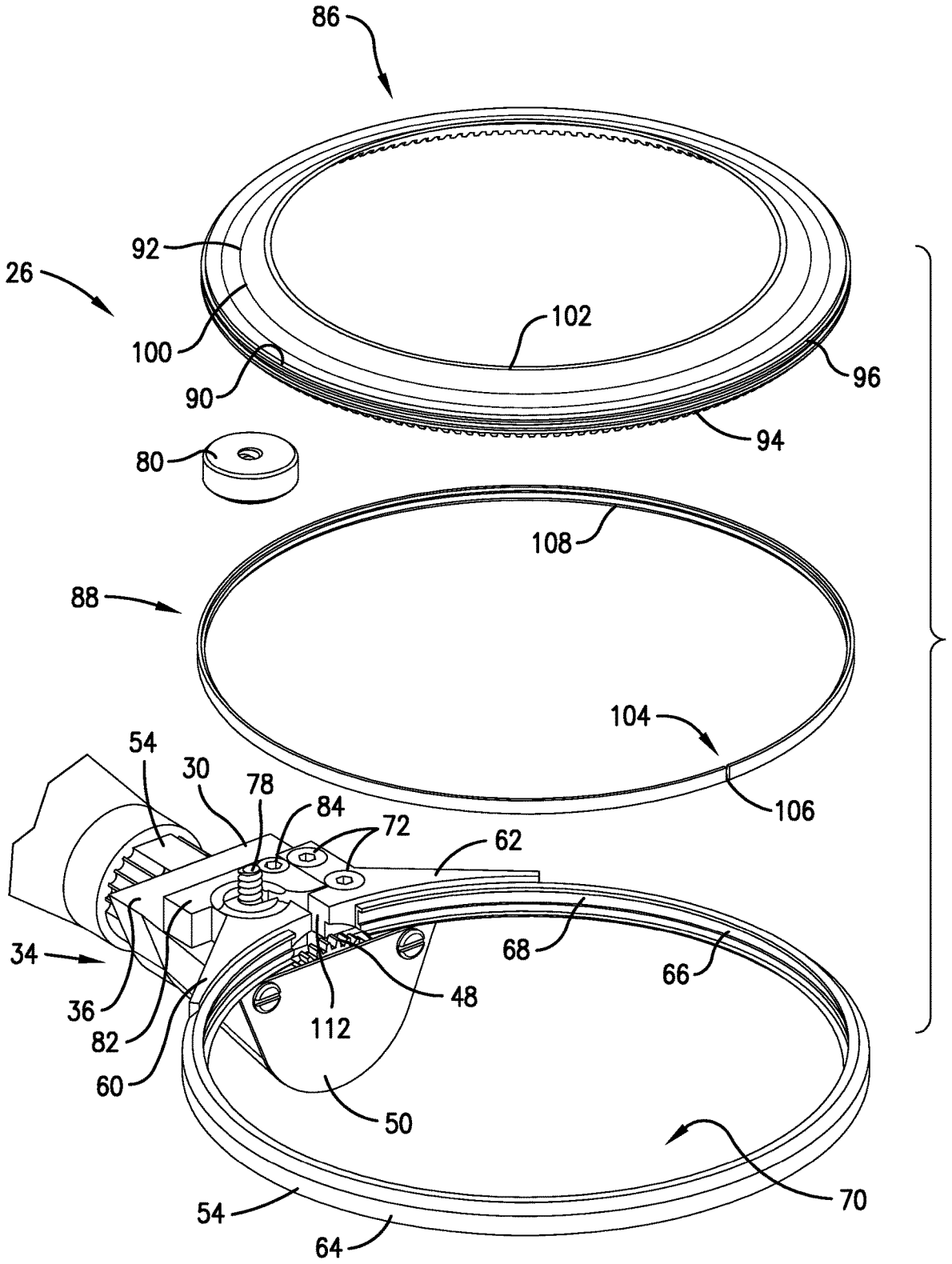
FIG. 4 is a fragmentary lower perspective of the rotary knife shown in FIGS. 1-3, particularly illustrating the blade assembly exploded from the blade carrier assembly.
Figure 5:
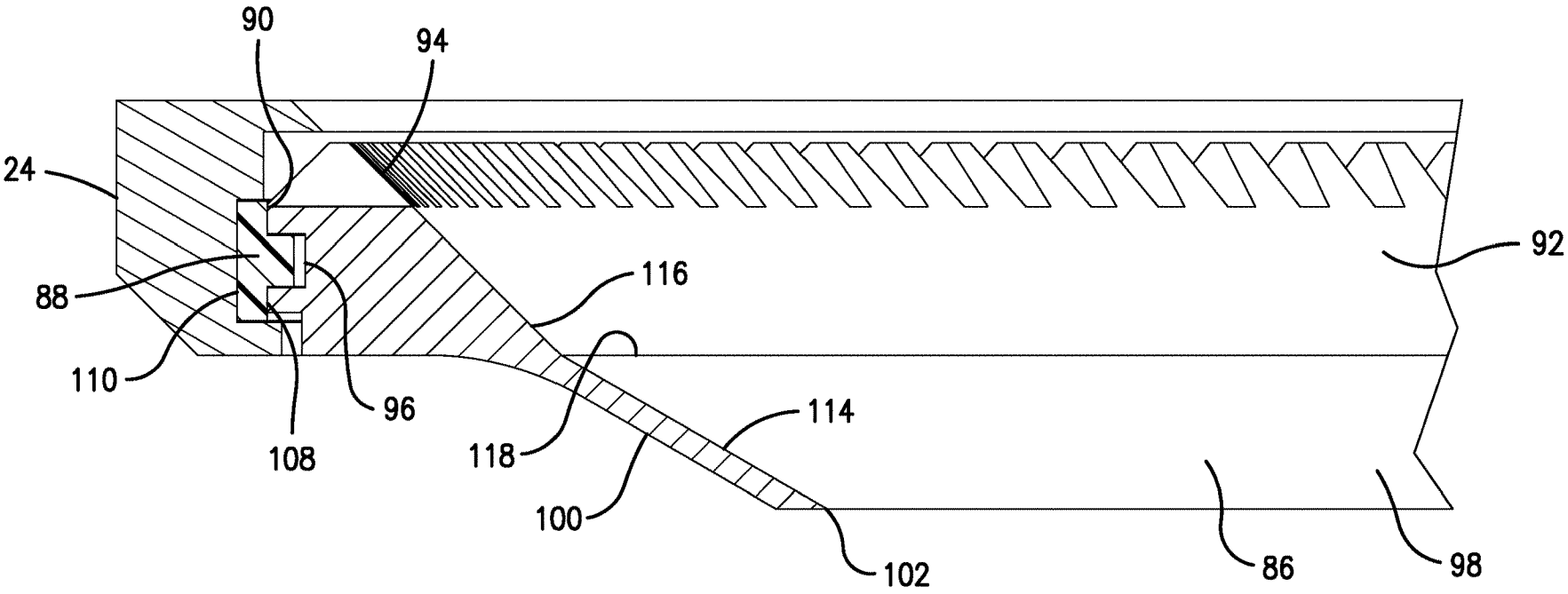
FIG. 5 is an enlarged fragmentary cross-section of the blade assembly and blade housing shown in FIGS. 1-4, depicting the bushing for supporting the blade on the housing.
Figure 6:
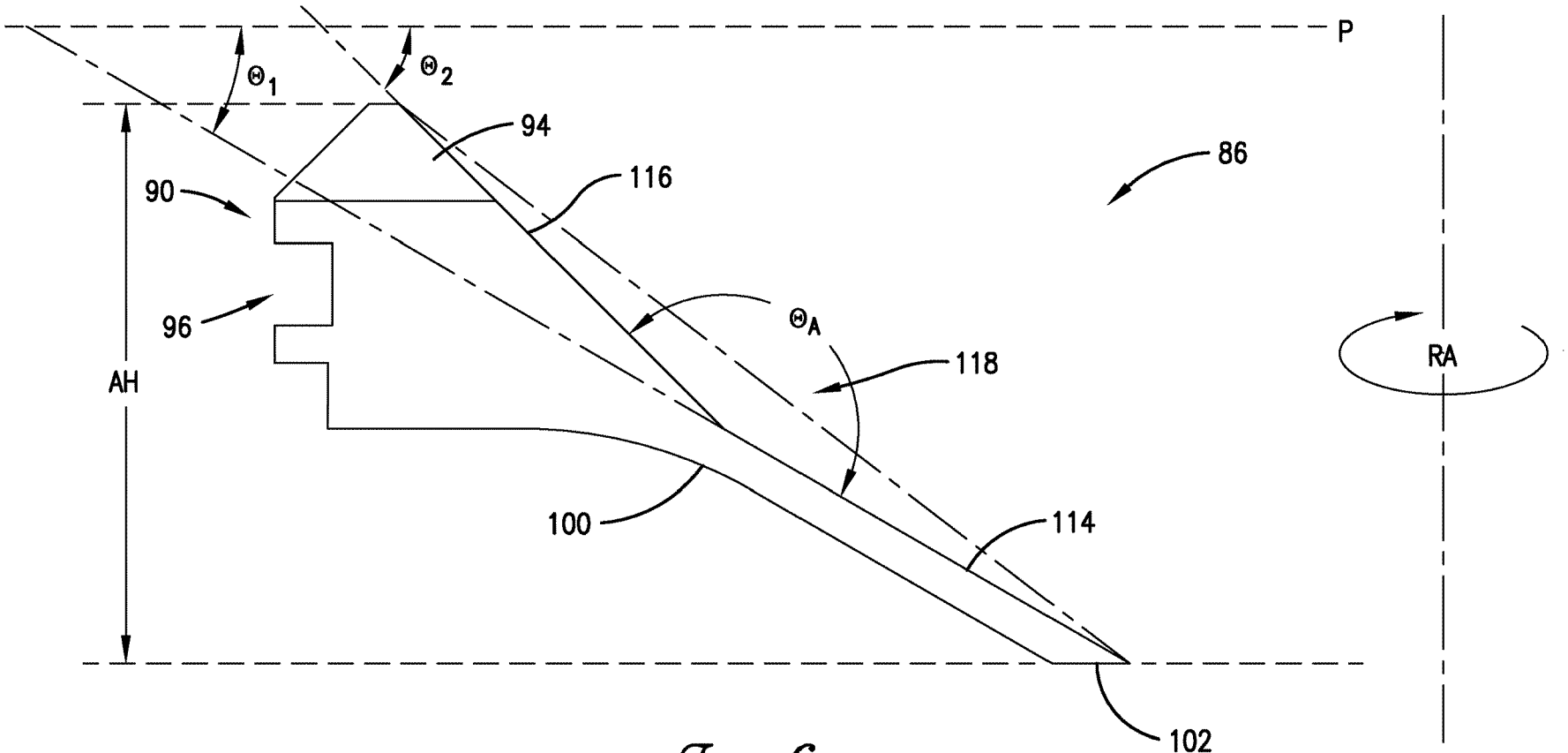
FIG. 6 is a cross-sectional view of the annular blade shown in FIGS. 1-5, showing the angled relationship between the sections of the inner surface of the annular blade.

Turning to FIGS. 4-6, the blade assembly 24 includes an annular blade 86 and an annular bushing 88. The illustrated blade 86 is unitary and is substantially continuous around its circumference. The blade 86 includes a support section 90 and a blade wall 92. The support section 90 includes a ring gear 94 for mating engagement with the spur gear 48. The support section 90 also includes an arcuate outer groove 96 which serves as a race for engagement with the bushing 88, as will be explained. The blade wall 92 includes annular inner and outer surfaces 98 and 100, respectfully. The surfaces 98 and 100 cooperatively define a terminal cutting edge 102.

The bushing 88 is preferably unitary and includes an annular body with bushing ends 104 (see FIG. 4). The ends 104 are located adjacent to each other preferably such that the annular body forms an essentially endless bearing surface. The principles of the present invention are also applicable where the body is in fact endless. The body preferably has an outermost diameter of between about one (1) to five (5) inches, although other sizes are entirely within the ambit of the present invention. If desired, the ends 104 may define a gap 106 therebetween (see FIG. 4). The gap 106 is preferably less than about one (1) inch and, more preferably, the gap 106 ranges from about one-tenth (0.1) of an inch to about three-tenths (0.3) of an inch. The bushing 88 is generally dimensioned and constructed so that it is operable to deform elastically during installation between the blade 86 and blade housing 56.

The annular body of the bushing 88 includes an inner perimeter surface 108 and an outer perimeter surface 110. The illustrated inner perimeter surface 108 includes shoulders that define an annular interior rib. The outer perimeter surface 110 includes a generally flat profile. However, other bushing shapes and designs are entirely within the ambit of the present invention. That is, the principles of the present invention are also applicable where the surfaces 108 and 110 include alternative convex or concave profiles. Moreover, the principles of the present invention are also applicable to a bushing with multiple segments. For example, the bushing 88 may include a plurality of substantially circular segments that are spaced relative to each other (e.g., concentrically spaced, or axially spaced). Alternatively, the bushing 88 may include arcuate segments arranged in series in a substantially circular form. The principles of the present invention are further applicable where the bushing includes a bearing other than a journal bearing, such as a ball bearing.

The bushing 88 preferably includes an ABS plastic or an Acetal plastic such as Delrin®. However, the principles of the present invention are also applicable where the bushing 88 is constructed from plastic, other non-metallic, or metallic materials suitable for use in a bushing application. For example, the bushing 88, either entirely or partly, may include an outermost layer of brass, composite, aluminum, or stainless steel that is suitable for surface-to-surface engagement with the blade 86 and blade housing 56. In this manner, such an outermost layer, whether coated, adhered, or otherwise secured onto the base material (e.g., plastic), may provide an optimal surface for low-friction bearing engagement. However, the outermost layer may be included for other purposes, such as corrosion resistance, aesthetic qualities, or other performance requirements.

Turning to FIGS. 4-5, when the bushing 88 is received within the outer groove 96 of the blade 86, the interior rib of the bushing 88 is spaced within and is configured to substantially conform to the shape of the outer groove 96. The bushing ends are normally spaced adjacent to each other with the small gap 106 remaining therebetween. Thus, the bushing 88 provides a substantially continuous circumference or bearing surface.

The blade assembly 26 is assembled onto the blade housing 56 by first inserting the bushing 88 into the housing groove 68. Insertion of the bushing 88 occurs by initially placing one of the ends 104 into the groove 68, which may require slight deformation of the bushing 88. Subsequently, the remainder of the bushing 88 may be placed within the groove 68 by progressively inserting portions of the bushing 88 along the circumferential direction. When the bushing 88 is received within the groove 68, the outer perimeter surface 110 is located within and is configured to substantially conform to the shape of the groove 68. It is noted that the gap 106 defined between the bushing ends 104 is preferably aligned with the housing gap 112 defined between the housing ends 60,62.

With the bushing 88 received in the housing 56, the blade 86 is preferably then coupled to the bushing 88, whereby the blade 86 is supported for rotation on the housing 56. More particularly, the blade housing 56 and bushing 88 are simultaneously and elastically deformed in an outward direction to expand in diameter, thus increasing the size of the gaps 106,112. As previously described, such expansion is preferably facilitated by the expansion assembly 58. The blade 86 is then located within the expanded housing 56 and bushing 88, with the housing groove 68 being preferably placed into an opposed relationship with the blade groove 96 (where "opposed relationship" is defined herein as the grooves 68,96 facing in opposite directions). More preferably, the illustrated grooves 68,96 are oppositely spaced from each other (with "oppositely spaced" defined herein as the grooves 68,96 being in opposed relationship and directly facing each other, i.e., not offset from each other along the blade axis). Those of ordinary skill in the art will appreciate that the bushing 88 may alternatively be first placed on the blade 86, and then the assembled blade assembly 26 positioned within the blade housing 56, without departing from the spirit of the present invention.

Again, the principles of the present invention are applicable where the grooves 68,96 are in opposed relationship to each other. For example, an alternative pair of circular grooves may have a common axis but be offset from each other along the axis. Furthermore, according to some aspects of the present invention, the housing and the blade groves may face in the same radial direction rather than being opposed, with an alternative bushing serving to supportingly connect the blade to the housing. The configuration of the races (which are determined by the grooves 68 and 96 in the illustrated embodiment) may also be varied without departing from the spirit of the present invention, as long as the bushing configuration is similarly varied. For example, the races need not be defined by the grooves or have an orthogonal shape. That is to say, the principles of the present invention are equally applicable to a rib that projects into a groove of the bushing, with both features having a curvilinear cross-sectional shape. Yet further, it is entirely within the ambit of the present invention for the bushing to be eliminated altogether. In such an alternative configuration, the blade directly engages the housing, as is often seen in the prior art. The manner in which the blade is rotatable supported may be varied as desired.

With the blade 86 supported on the housing 56, the blade 86 is rotatable about an axis RA (see FIG. 6). The inner surface 98 tapers generally inward toward the axis RA and includes a first section 114 and a second section 116. The first section 114 extends from the cutting edge 102. The second section 116 extends from the first section 114 to the opposite axial end of the blade (defined by the support section 90).

As perhaps best shown in FIG. 6, the first section 114 and second section 116 are angled relative to one another, which provides at least a double-beveled inner surface 98. Preferably, the first section 114 and the second section 116 are positioned relative to one another such that an obtuse angle $\theta_A$ is defined therebetween. Preferably, the angle $\theta_A$ is between about one hundred degrees (100°) and one hundred and seventy degrees (170°). Most preferably, the angle $\theta_A$ is about one hundred sixty five degrees (165°). The first section 114 defines a first angle $\theta_1$ relative to an imaginary plane P transverse to the axis RA. The second section 116 defines a second angle $\theta_2$ relative to the plane P. The second angle $\theta_2$ is preferably greater than the first angle $\theta_1$ by at least about ten degrees (10°). Most preferably, the first angle $\theta_1$ is about thirty degrees (30°) and the second angle $\theta_2$ is about forty-five degrees (45°).

The illustrated inner surface 98 includes only the two (2) relatively angled sections 114 and 116. It will be appreciated, however, that the inner surface may be alternatively configured without departing from the spirit of the present invention. For example, the inner surface may alternatively include three (3) or more sections, all or only some of which are angled relative to one another. In such an arrangement, it is not necessary for the entire inner surface to taper inwardly toward the axis RA. Furthermore, for some aspects of the present invention, it is not necessary for the relatively angled sections of the inner surface to be immediately adjacent one another. Most preferably, the first section 114 projects from the cutting edge 102 and the second section 116 is simply located further from the cutting edge 102 than the first section 114. The principles of the present invention similarly encompass the second section being spaced from the support section 90 of the blade.

In the illustrated embodiment, each of the first and second sections 114 and 116 is generally frusto-conical in shape. Furthermore, the sections 114 and 116 preferably have similar lengths (as measured along the angled plane presented by each face). According to some aspects of the present invention, however, the sections of the inner surface 98 may each be alternatively shaped and/or sized. It is important for at least two (2) of the sections to present an angle therebetween (even if such sections are curvilinear, a primary direction of extension defined by each section must be angled relative to the other).

The relatively angled sections 114 and 116 define a transition area 118, which is generally defined by the most adjacent portions of the sections 114 and 116. Preferably, the transition area 118 presents a concavity along which the tissue must travel. In the illustrated embodiment, with the sections 114 and 116 being immediately adjacent one another, the transition area 118 is defined by a sharp apex. As the blade 86 cuts through tissue, any tissue contacting the inner surface must make a turn from the first section 114 to the second section 116. With the illustrated sharp transition area 118, the tissue must abruptly change direction. In any case, the transition area 118 causes the tissue to at least temporarily separate from the inner surface 98. The resulting air gap considerably reduces the surface tension between the blade and tissue, which greatly reduces the force required to move the knife 20 in the cutting direction.

In addition to reducing surface tension, the preferred configuration of the inner surface 98 also permits the blade 86 to be sharpened a relatively large number of times. Specifically, when an annular blade is sharpened, the axial height of the annular blade AH (see FIG. 6) is reduced due to loss of blade material inherent to the sharpening process. The extent to which the axial height AH is reduced upon sharpening is directly proportional to the angle between the blade wall and the plane P. That is, the greater the angle between the blade wall and the plane P, the greater the extent by which the axial height AH of the blade is reduced upon sharpening. In the illustrated embodiment, the first section 114 (which is the portion of the blade 86 removed during sharpening operations) defines a relatively small angle small $\theta_1$. Therefore, as the blade is repeatedly sharpened, the axial height AH is not significantly reduced. The blade 86 nonetheless maintains a suitable minimum height because the second section 116 defines a sharper angle $\theta_2$ than the first section 114. In other words, the majority of the blade height AH is defined by the second section 116. Thus, by constructing the inner surface 98 according to the present invention, the reduction of the axial height AH caused by sharpening is relatively less than most traditional blades.

If desired, the blade 86 may be alternatively configured to include other types of edges. For example, instead of the cutting edge 102, the blade 86 could alternatively include an abrasive edge (e.g., with a surface that is gritted), a bristled edge, or a brush-type shredding edge. Similar to the blade housing 56, it is consistent with the principles of the present invention for the blade 86 to include multiple grooves (e.g., for engagement with multiple bushings). Moreover, it is also within the ambit of the present invention for the groove 96 to include alternative surface features.

The blade 86 is preferably manufactured from tempered steel. However, similar to the blade housing 56 and frame 22, the principles of the present invention are applicable where the blade 86 includes other metallic or non-metallic materials, such as brass, composite, aluminum, or stainless steel. Alternatively, the blade 86, either entirely or partly, may include an outermost layer of brass, aluminum, or stainless steel that is suitable for surface-to-surface engagement with the bushing 88 or the housing 56, if the bushing is eliminated. In this manner, such an outermost layer, whether coated, adhered, or otherwise secured onto the base material, may provide an optimal surface for low-friction bearing engagement. However, the outermost layer may be included for other purposes, such as corrosion resistance, aesthetic qualities, or other performance requirements.

In use, power is supplied to the knife 20, which causes the spur gear (or pinion) 48 to rotate. The driving interengagement between the pinion 48 and ring gear 94 in turn causes the blade 86 to rotate about the axis AR. The knife 20 is than manipulated (preferably manually) to move the blade 86 through the tissue (not shown). Because of the configuration of the inner surface 98, surface tension between the tissue and blade 86 is noticeably reduced, thereby lessening the force required to manipulate the knife 20 during cutting operations.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A rotary knife comprising:

a frame;

a blade housing supported on the frame; and an annular blade supported on the blade housing for rotational movement about an axis, said blade presenting an annular inner blade surface that terminates at a cutting edge, said inner blade surface including first and second sections, with the first section extending from the cutting edge and the second section being located further from the cutting edge than the first section, said first and second sections of the inner blade surface being angled relative to one another, said first and second sections of the inner blade surface being immediately adjacent one another and forming a transition area therebetween, said transition area being a sharp apex, said first section defining a first angle relative to an imaginary plane transverse to the axis, said second section defining a second angle relative to the imaginary plane, said second angle being at least about ten degrees greater than the first angle.

2. The rotary knife as claimed in claim 1, said inner blade surface generally tapering inwardly to the cutting edge.

3. The rotary knife as claimed in claim 2, said first and second sections of the inner blade surface cooperatively defining an obtuse angle therebetween.

4. The rotary knife as claimed in claim 3, each of said first and section sections of the inner blade surface being generally frusto-conical in shape.

5. The rotary knife as claimed in claim 1, said second angle being at least about forty-five degrees, said first angle being about thirty degrees.

6. The rotary knife as claimed in claim 1, said blade including a support section.

7. The rotary knife as claimed in claim 6, said second section terminating at the support section.

8. The rotary knife as claimed in claim 6, said support section presenting a blade bearing surface, said blade housing presenting a housing bearing surface in an opposed relationship with the blade bearing surface.

9. The rotary knife as claimed in claim 8, further comprising:

an annular bushing received on the bearing surfaces, said annular bushing rotatably supporting the blade on the blade housing.

10. The rotary knife as claimed in claim 6, said support section including a gear-engaging portion to facilitate rotational movement about the axis.

11. The rotary knife as claimed in claim 1, said frame being a handle configured for human grasping.

12. The rotary knife as claimed in claim 1, said blade housing being configured to removably support the blade.

* * * * *